US011975374B2

(12) United States Patent
Rönpagel et al.

(10) Patent No.: US 11,975,374 B2
(45) Date of Patent: May 7, 2024

(54) APPARATUS AND METHOD FOR PRODUCING A PERIPHERAL GROOVE IN AN END PORTION OF A METAL TUBE

(71) Applicant: MV Pipe Technologies GmbH, Wittenberge (DE)

(72) Inventors: Andreas Rönpagel, Ahrensburg (DE); Jan Ehlers, Scharbeutz (DE)

(73) Assignee: MV Pipe Technologies GmbH, Wittenberge (DE)

( * ) Notice: Subject to any disclaimer, the term of this patent is extended or adjusted under 35 U.S.C. 154(b) by 0 days.

(21) Appl. No.: 17/376,056

(22) Filed: Jul. 14, 2021

(65) Prior Publication Data

US 2021/0339304 A1 Nov. 4, 2021

Related U.S. Application Data

(63) Continuation of application No. 16/469,756, filed as application No. PCT/EP2017/082772 on Dec. 14, 2017, now abandoned.

(30) Foreign Application Priority Data

Dec. 15, 2016 (DE) ..... 10 2016 124 487.2

(51) Int. Cl.
*B21D 17/04* (2006.01)
*B21B 27/02* (2006.01)
*B21D 41/00* (2006.01)

(52) U.S. Cl.
CPC ..... *B21D 17/04* (2013.01); *B21B 27/024* (2013.01); *B21D 41/00* (2013.01); *B21B 2203/18* (2013.01)

(58) Field of Classification Search
CPC ..... B21D 17/04; B21D 19/04; B21D 19/043; B21D 41/00; B21B 27/024
(Continued)

(56) References Cited

U.S. PATENT DOCUMENTS 2,024,803 A * 12/1935 Nelson ..... B21D 17/04 72/101
2,085,710 A 6/1937 Tornblom et al.
(Continued)

FOREIGN PATENT DOCUMENTS

AT 350 354 B 5/1979
CN 2638878 Y 9/2004
(Continued)

OTHER PUBLICATIONS

EP 1518616 A2, Biland, Mar. 2005.*
(Continued)

*Primary Examiner* — Edward T Tolan
(74) *Attorney, Agent, or Firm* — Perkins Coie LLP

(57) ABSTRACT

The invention relates to an apparatus (1) for producing a peripheral groove (101) in an end portion (103) of a metal tube (100), in particular a metal tube (100) which is to be coated on the inside, the groove (101) being set up for receiving tube connectors, having a first, rotationally driven roller (3), a second, freely rotating roller (5), the first roller (3) having a roughened or structured surface (6) relative to the second roller (5), a pressing device (15) for producing a relative movement between the first and second roller (3, 5), between a first and a second position, the rollers (3, 5) assuming a first spacing from one another in the first position, which first spacing permits an introduction of a wall of the tube between the rollers (3, 5), and assuming a smaller, second spacing from one another in the second position, which second spacing is smaller than a material thickness (M) of the wall of the tube.
It is proposed according to the invention that the first, driven roller (3) is set up to grip the tube from the outside in the second position and to rotate it, with the result that a
(Continued)

peripheral groove (101) is pressed into the tube in the second position when the first roller (3) is driven.

11 Claims, 1 Drawing Sheet

(58) Field of Classification Search
USPC ..... 72/105, 108, 703
See application file for complete search history.

(56) References Cited

U.S. PATENT DOCUMENTS

| | | | | | |
|---|---|---|---|---|---|
| 2,809,687 | A | | 10/1957 | Ogle | |
| 3,191,416 | A | | 6/1965 | Pritchett et al. | |
| 3,290,914 | A | | 12/1966 | Vaill et al. | |
| 3,667,265 | A | | 6/1972 | Zippe | |
| 3,995,466 | A | * | 12/1976 | Kunsman | B21D 17/04 72/370.21 |
| 4,091,648 | A | * | 5/1978 | McCaslin | B21D 39/04 72/123 |
| 4,114,414 | A | * | 9/1978 | Goodman | B21D 17/04 72/105 |
| 4,144,733 | A | * | 3/1979 | Whitten | B21D 17/04 72/105 |
| 4,210,008 | A | * | 7/1980 | Birkestrand | B21D 19/005 72/105 |
| 5,279,143 | A | | 1/1994 | Dole | |
| 5,570,603 | A | | 11/1996 | Chatterley et al. | |
| 6,196,039 | B1 | | 3/2001 | Williams et al. | |
| 7,296,451 | B2 | * | 11/2007 | Dole | F16L 43/00 72/123 |
| 10,369,609 | B2 | * | 8/2019 | DiPierdomenico | B21D 17/04 |
| 2012/0139236 | A1 | | 6/2012 | Novitsky et al. | |

FOREIGN PATENT DOCUMENTS

| | | | |
|---|---|---|---|
| CN | 203578483 | U | 5/2014 |
| CN | 105382067 | A | 3/2016 |
| CN | 205763168 | U | 12/2016 |
| DE | 28 33 958 | A1 | 2/1980 |
| DE | 690 08 347 | T2 | 8/1994 |
| DE | 693 12 042 | T2 | 12/1997 |
| GB | 262569 | A | 12/1926 |
| GB | 393444 | A | 6/1933 |
| GB | 2 014 072 | A | 8/1979 |
| WO | WO 2016/032707 | A1 | 3/2016 |

OTHER PUBLICATIONS

International Search Report (with English translation), International Application No. PCT/EP2017/082772 (published under WO 2018/109067), 5 pages (dated Mar. 9, 2018).

Written Opinion (with English translation), International Application No. PCT/EP2017/082772 (published under WO 2018/109067), 9 pages (dated Mar. 9, 2018).

First Office Action (with English translation), Chinese Application No. 201780078075.3, 20 pages (dated Mar. 2, 2020).

* cited by examiner

APPARATUS AND METHOD FOR PRODUCING A PERIPHERAL GROOVE IN AN END PORTION OF A METAL TUBE

PRIORITY CLAIM AND INCORPORATION BY REFERENCE

This application is a continuation of U.S. patent application Ser. No. 16/469,756, filed Jun. 14, 2019, which is a 35 U.S.C. § 371 application of International Application No. PCT/EP2017/082772, filed Dec. 14, 2017, which claims the benefit of German Application No. 10 2016 124 487.2, filed Dec. 15, 2016, each of which is incorporated by reference in its entirety.

TECHNICAL FIELD

The invention relates to an apparatus for producing a peripheral groove in an end portion of a metal tube, in particular a metal tube which is to be coated on the inside, the groove being set up for receiving tube connectors, having a first, rotationally driven roller, a second, freely rotating roller, the first roller having a roughened or structured surface relative to the second roller, a pressing device for producing a relative movement between the first and second roller, between a first and a second position, the rollers assuming a first spacing from one another in the first position, which first spacing permits an introduction of a wall of the tube between the rollers, and assuming a smaller, second spacing from one another in the second position, which second spacing is smaller than a material thickness of the wall of the tube.

Furthermore, the invention relates to a method for producing a peripheral groove in an end portion of a metal tube, in particular a metal tube to be coated on the inside, the groove being set up for receiving tube connectors.

BACKGROUND AND SUMMARY OF THE INVENTION

Tubes of the above-described type are used in industrial plants for a very wide range of uses, in particular also in fire extinguishing systems, however. In systems of this type, pipeline systems are used, by way of which great distances sometimes have to be bridged. For this purpose, single-piece tubes cannot always be used, but rather pipelines have to be formed from a plurality of tubes which are put together. In order to connect tubes to one another on the end side, they are coupled to one another by way of tube connectors. In order that the tube connectors can be mounted on the tubes captively and reliably, peripheral grooves are made in the outer circumferential face of the metal tubes in a known way which is described above. As a consequence of the first and second rollers being pressed against one another, a pressing force is exerted on the metal tube, which pressing force makes it possible to press a groove into the tube by way of deformation of the metal tube, and the tube is rotated by way of the driven roller to this end.

The structured surface of the driven roller which is necessary to produce a sufficient adhesive friction can press a negative structure which corresponds with the structuring into the wall of the roller in the case of correspondingly high pressing forces which become necessary in the case of certain material thicknesses of the metal tubes. An irregularity is then unintentionally configured in the surface of the metal tube at the corresponding location, at which the driven roller was previously seated. This can prove disadvantageous for following coating operations of the metal tube. In particular in medium-conducting systems, for example fire extinguishing systems, the corrosion resistance on the inner side of the metal tubes is a critical requirement. Roughening of the surface at the location of the driven roller on the tube inner side impairs the possibility of the configuration of an adequate corrosion-inhibiting layer. This is considered to be worthy of improvement.

Against this background, the invention was based on the object of improving the apparatus of the type denoted at the outset in such a way that the abovementioned disadvantages are reduced as far as possible or are overcome. In particular, the invention was based on the object of improving the apparatus in such a way that the possibility for subsequent inner coating of the metal tubes which are provided with a groove is improved.

The invention achieves the object on which it is based in the case of an apparatus of the type denoted at the outset, by said apparatus being configured according to the invention. According to the invention, the first, driven roller is set up to grip the tube from the outside in the second position and to rotate it, with the result that a peripheral groove is pressed into the tube in the second position when the first roller is driven. Here, the invention follows the approach of not allowing the driven roller (as in the prior art) to circulate on the inner side of the metal tube, but rather of placing the roller onto the tube from the outside and of producing the structuring on the outer circumferential face of the tube. Should stamping of a structuring into the circumferential face of the tube then occur in the case of correspondingly high pressing forces, said structuring lies outside the inner tube region to be coated and does not further impair the configuration of a corresponding coating. A roughness in the peripheral groove on the outer side of the tube does not have a disadvantageous effect on the receiving capability of a tube connector and can therefore be accepted.

The first and second roller are preferably oriented parallel to one another, the structuring of the surface preferably being configured by means of a grooved or knurled portion. Further preferably, the relative movement of the first and second rollers takes place transversely with respect to the rotational axis of the tube.

In one preferred development, the apparatus has exactly two rollers. In comparison with apparatuses which were known from the prior art and in part had a greater number of rollers, this is a considerable structural simplification which at the same time does not entail an impairment of the reproducibility of the groove contour.

The second roller preferably has a greater width than the first roller.

With respect to its further preferred embodiment, the first roller is oriented centrally in the direction of its rotational axis with respect to the second roller.

In a further preferred embodiment, the second roller has, preferably centrally in the direction of its rotational axis, a peripheral recess which is dimensioned in such a way that the first roller presses the tube which is situated between the rollers into the recess in the second position. The width of the recess preferably exceeds the width of the first roller by at least twice the material thickness of the tube.

The width of the recess of the second roller particularly preferably exceeds the width of the first roller in such a way that the first roller and the second roller define a gap with the contour of the peripheral groove in the second position.

Further preferably, those peripheral edges of the first roller and/or the second roller which are in contact with the tube in the second position are rounded. This reduces stress peaks in the material of the tube, which has a positive influence on the fatigue strength and corrosion resistance of the tube, and also reduces the wear of the first and second rollers.

Further preferably, the pressing device is set up to move the first roller transversely with respect to its rotational axis, or to move the second roller transversely with respect to the rotational axis. The respective other roller is preferably arranged fixedly relative to the rotational axis of the metal tube.

In the present case, the invention has been described in accordance with a first aspect in relation to the apparatus according to the invention. In accordance with a second aspect, the invention achieves the object which is formulated above in the case of a method of the type denoted at the outset having the following steps:

providing of a first, rotationally driven roller, and a second, freely rotating roller in a first position, the rollers assuming a first spacing from one another in the first position, which first spacing permits the introducing of a wall of the tube between the rollers, introducing of the wall between the first roller and the second roller, producing a relative movement between the first and second roller from the first into a second position, in which the rollers assume a smaller, second spacing from one another, which second spacing is smaller than a material thickness of the wall of the tube, the gripping and rotating of the tube taking place by means of the first driven roller from the outside in the second position, with the result that a peripheral groove is pressed into the tube in the second position. With regard to the advantages which the invention in accordance with the second aspect makes its own, reference is made to the above statements with respect to the apparatus according to the invention.

Furthermore, the method according to the invention makes the same advantages and preferred embodiments its own as the above-described apparatus according to the invention.

In particular, the method is developed by way of the following step: pressing of the tube which is situated between the rollers in the second position into a recess which runs around on the second roller, preferably centrally in the direction of its rotational axis, by means of the first roller, preferably into a gap with the contour of the peripheral groove, which gap is defined between the first roller and the second roller in the second position.

The relative movement between the first and the second roller is preferably produced by way of movement of the first roller transversely with respect to its rotational axis, or by way of movement of the second roller transversely with respect to its rotational axis.

The method in accordance with the second aspect of the invention is preferably embedded into a method for internal coating of a tube, the method then comprising, furthermore, the following steps according to the invention in addition to the method according to one of the above-described preferred embodiments:

cleaning of the tube, in particular by means of one, more or all of the following measures: degreasing, rinsing, in particular with deionized water, pickling;

coating of the inner side of the tube, in particular by means of application of a coating on a chemical basis, in particular an autodeposition coating. The coating material is preferably water-based autodeposition material, polyvinylidene chloride (PVDC) or epoxy urethane acrylate particularly preferably being used as resin. The coating operation preferably takes place by means of feeding of a dispersion comprising an acid, for example FeF3 iron fluoride, and paint particles, the acid (for example, the FeF3 iron fluoride) bringing about a release of Fe2+ ions on the inner-side surface of the metal tube, which ions bond with the paint particles and then accumulate on the inner-side surface of the metal tubes again. For example, the BONDERITE™ M-PP material (formerly Aquence™) from the Henkel company in Dusseldorf, Germany is worth considering as the above-described coating material.

BRIEF DESCRIPTION OF THE DRAWINGS

The invention will be described in greater detail in the following text using one preferred exemplary embodiment with reference to the appended figures, in which.

MODE(S) FOR CARRYING OUT THE INVENTION

Figures 1, 2:
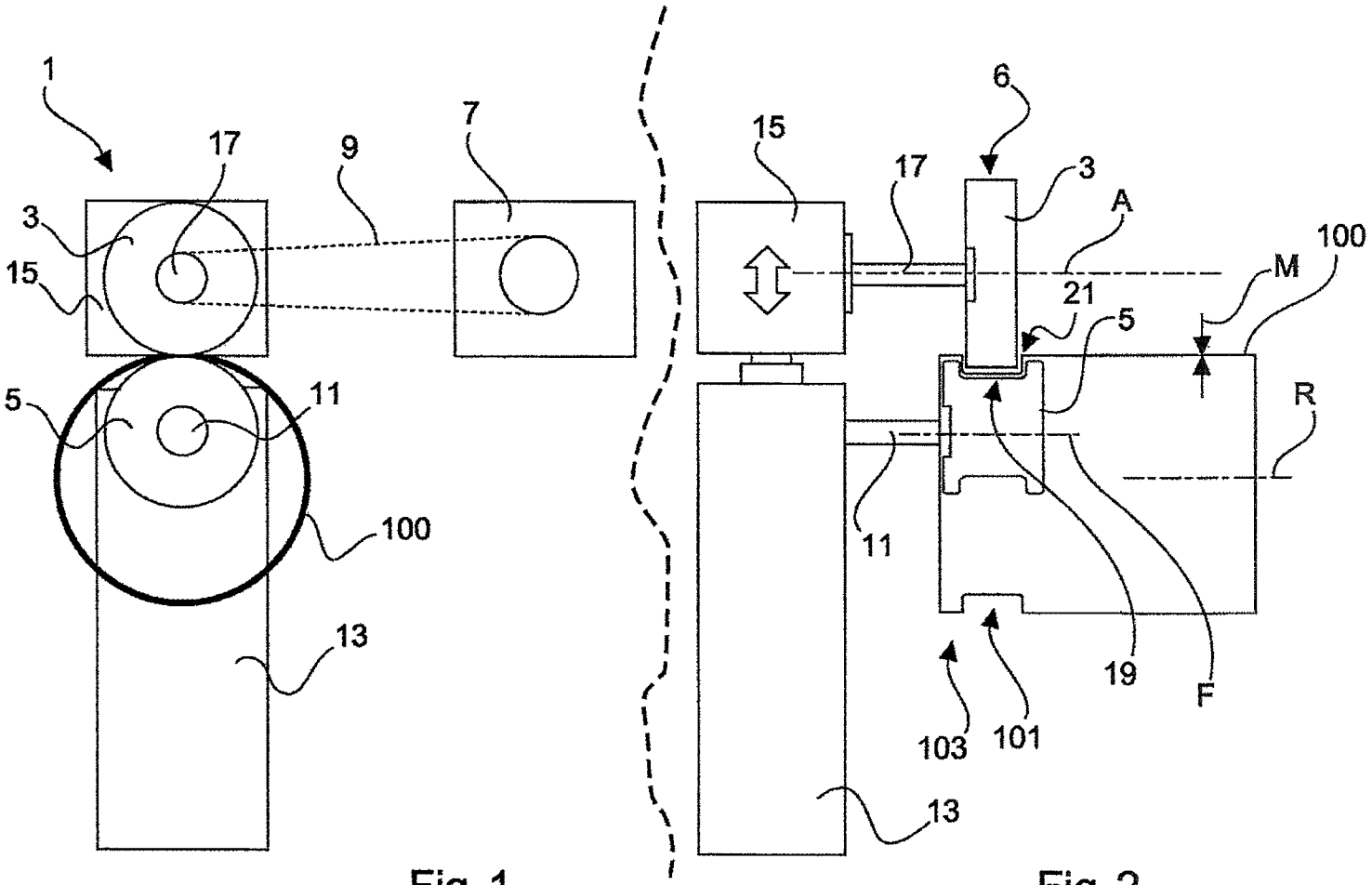
FIG. 1 shows a diagrammatic side view of an apparatus for generating a peripheral groove in accordance with one preferred exemplary embodiment.
FIG. 2 shows a diagrammatic further side view of the apparatus according to FIG. 1.

FIG. 1 shows an apparatus 1 for producing a peripheral groove 101 (FIG. 2) in a metal tube 100. The apparatus has a first roller 3 and a second roller 5, the first roller 3 being driven rotationally, whereas the second roller 5 is preferably mounted such that it can rotate freely. The first, driven roller 3 is mounted by means of a first bearing 17, whereas the second roller 5 is mounted by means of a second bearing 11. In the exemplary embodiment which is shown, the first roller 3 is connected to a drive unit 7 by means of a drive means 9, for example a drive chain or a drive belt or toothed belt. In an alternative embodiment which is not shown, the first roller 3 is preferably driven by electric motor, it then being possible for the electric motor to be arranged directly on the housing with the apparatus 1, which housing also carries the bearing 17.

The freely rotating roller 5 is arranged on a load-bearing structure 13, whereas the first, driven roller 3 is arranged on a pressing device 15.

As is shown clearly, in particular, from FIG. 2, the pressing device 15 can be moved relative to the load-bearing structure 13. By way of said relative movement, the first, driven roller 3 is moved relative to the second, freely rotating roller 5 transversely with respect to a rotational axis R of the metal tube 100. The first roller 3 can be moved such that it is driven rotationally about a rotational axis A.

In terms of the width in the direction of the rotational axis A or the rotational axis R of the metal tube 100 or in the direction of the rotational axis F of the freely rotating roller 5, the second roller 5 exceeds the width of the first roller 3. Furthermore, the second roller 5 has a recess 19 on its circumferential face, which recess 19 exceeds the width of the first roller 3 to such an extent that a gap 21 is configured between the first and the second roller 3, 5 when the first roller 3 has moved from a first position into the second position (shown in the figures).

In the first position (not shown), the first and second roller 3, 5 are spaced apart from one another to such an extent that the metal tube 100 can be guided with its material thickness M between the rollers 3, 5, in order to be arranged with an end portion 103 between the rollers 3, 5. When the tube 100 is arranged correspondingly with its end portion 103, the first roller 3 is moved rotationally and is pressed against the second roller 5 by means of the pressing device 15, with the result that the material of the metal tube 100 is pressed into the gap 21 between the rollers 3, 5, as a result of which a groove 101 is produced on the outside in the end portion 103 of the metal tube.

The structuring of the surface 6 of the first roller 3 which is necessary for rotating the tube 100 is therefore pressed exclusively onto the outer circumferential face of the tube 100, with the result that the inner face of the tube 100 can remain completely smooth, in particular in the end portion 103, with the exception of the protrusion of the groove 101 into the interior. The subsequent application of a corrosion protection layer or other coating is possible in an unrestricted manner.

As an alternative to the embodiment which is shown here, it goes without saying that it would also be possible to configure the second roller 5 including the bearing 11 in a height-adjustable manner relative to the load-bearing structure 13, with the result that the metal tube 100 is set rotationally in movement by the first roller 3, but the other force is exerted by the second roller 5.

LIST OF UTILIZED REFERENCE NUMBERS

1 Apparatus for producing a peripheral groove
3 First, rotationally driven roller
5 Second, freely rotatable roller
6 Surface
7 Drive unit
9 Drive means
11 Bearing
13 Load-bearing structure
15 Pressing device
17 Bearing
19 Recess
21 Gap
100 Metal tube
101 Groove
103 End portion
A, F Rotational axis
M Material thickness

The invention claimed is:

1. An apparatus for producing a peripheral groove in an end portion of a metal tube which is to be coated on an inside of the metal tube, the peripheral groove being set up for receiving tube connectors, the apparatus, comprising:

a first, rotationally driven roller, a second, freely rotating roller, the first roller having a roughened or structured surface relative to the second roller, and a pressing device for producing a relative movement between the first and second roller, between a first and a second position, the rollers assuming a first spacing from one another in the first position, which first spacing permits an introduction of a wall of the metal tube between the rollers, and assuming a smaller, second spacing from one another in the second position, which second spacing is smaller than a material thickness of the wall of the metal tube, wherein the first, driven roller is set up to grip the metal tube from an outside of the metal tube in the second position and to rotate it such that a peripheral groove is pressed into the metal tube in the second position when the first roller is driven, and a structuring is provided on an outer circumferential face of the metal tube exclusively with the peripheral groove.

2. The apparatus as claimed in claim 1, the apparatus consists of exactly two rollers.

3. The apparatus as claimed in claim 1, wherein the second roller having a greater width than a width of the first roller.

4. The apparatus as claimed in claim 3, wherein the first roller being oriented centrally in the direction of its rotational axis with respect to the second roller.

5. The apparatus as claimed in claim 4, the second roller having, centrally in the direction of its rotational axis, a peripheral recess which is dimensioned such that the first roller presses the tube which is situated between the rollers into the recess in the second position.

6. The apparatus as claimed in claim 5, wherein a width of the recess of the second roller exceeds the width of the first roller such that the first roller and the second roller define a gap with the contour of the peripheral groove in the second position.

7. The apparatus as claimed in claim 1, wherein peripheral edges of the first roller and/or the second roller which are in contact with the tube in the second position being rounded.

8. The apparatus as claimed in claim 1, wherein the pressing device being set up to move the first roller transversely with respect to its rotational axis; or the pressing device being set up to move the second roller transversely with respect to its rotational axis.

9. A method for producing a peripheral groove in an end portion of a metal tube which is to be coated on an inside of the metal tube, the groove being set up for receiving tube connectors, comprising the steps:

providing of a first, rotationally driven roller and a second, freely rotating roller in a first position, the rollers assuming a first spacing from one another in the first position, which first spacing permits an introduction of a wall of the metal tube between the rollers, introducing of the wall between the first roller and the second roller, producing of a relative movement between the first and second roller from the first into a second position, in which the rollers assume a smaller, second spacing from one another which is smaller than a material thickness of the wall of the tube, and gripping and rotating of the metal tube by the first driven roller in the second position from an outside of the metal tube such that a peripheral groove is pressed into the metal tube in the second position, producing a structuring exclusively on an outer circumferential face of the metal tube, and confining the structuring within the peripheral groove.

10. The method as claimed in claim 9, comprising the step:

pressing of the metal tube which is situated between the rollers in the second position into a recess which runs around on the second roller, in the direction of its rotational axis, by the first roller, into a gap with the contour of the peripheral groove, which gap is defined between the first roller and the second roller in the second position.

11. The method as claimed in claim 10, wherein the relative movement between the first and second roller being produced by movement of the first roller transversely with respect to its rotational axis; or the relative movement between the first and second roller being produced by movement of the second roller transversely with respect to its rotational axis.

* * * * *